US006150309A

United States Patent [19]

Gao et al.

[11] Patent Number: 6,150,309

[45] **Date of Patent: *Nov. 21, 2000**

[54] LUBRICANT FORMULATIONS WITH DISPERSANCY RETENTION CAPABILITY (LAW684)

[75] Inventors: Jason Z. Gao; Kim E. Fyfe; John D. Elnicki, all of Sarnia, Canada

[73] Assignee: Exxon Research and Engineering Co., Florham Park, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/130,211

[22] Filed: Aug. 4, 1998

[51] Int. Cl.[7] ..... C10M 141/08; C10M 141/06

[52] U.S. Cl. ..... 508/364; 508/563

[58] Field of Search ..... 508/364, 563

[56] References Cited

U.S. PATENT DOCUMENTS

| | | | |
|---|---|---|---|
| 4,178,258 | 12/1979 | Papay et al. | 508/364 |
| 4,812,246 | 3/1989 | Yabe | 508/364 |
| 5,091,099 | 2/1992 | Evans et al. | 252/48 |
| 5,605,880 | 2/1997 | Arai et al. | 508/379 |
| 5,627,146 | 5/1997 | Tanaka et al. | 508/364 |
| 5,650,381 | 7/1997 | Gatto et al. | 508/364 |
| 5,672,572 | 9/1997 | Arai et al. | 508/364 |
| 5,688,748 | 11/1997 | Tomizawa | 508/363 |
| 5,707,942 | 1/1998 | Arai et al. | 508/365 |
| 5,731,273 | 3/1998 | Field | 508/364 |
| 5,744,430 | 4/1998 | Inoue et al. | 508/295 |
| 5,807,813 | 9/1998 | Yamada | 508/364 |

FOREIGN PATENT DOCUMENTS

| | | | |
|---|---|---|---|
| 0346283 | 12/1989 | European Pat. Off. | C10M 141/06 |
| 0447916 | 9/1991 | European Pat. Off. | C10M 141/00 |
| 0696636 | 2/1996 | European Pat. Off. | C10M 169/04 |
| 0860495 | 8/1998 | European Pat. Off. | C10M 163/00 |
| 9507966 | 3/1995 | WIPO | C10M 141/10 |
| 9637583 | 11/1996 | WIPO | C10M 139/00 |

*Primary Examiner*—Jacqueline V. Howard

[57] ABSTRACT

The use of oil soluble organo molybdenum compounds in combination with phenolic or amenic antioxidants has been found to improve the dispersancy retention capability of crankcase lubricants. Thus in one embodiment the present invention comprises improving dispersancy retention of a crankcase lubricant by including in the crankcase lubricant composition an oil soluble organomolybdenum compounds and at least one of a phenolic or aminic antioxidant. Particularly preferred organomlybdenum compounds are molybdenum dithiocarbamates while a mixture of a diarylamine and two phenolic antioxidants are preferred.

6 Claims, No Drawings

LUBRICANT FORMULATIONS WITH DISPERSANCY RETENTION CAPABILITY (LAW684)

FIELD OF INVENTION

This invention relates generally to improvements in crankcase lubricants and especially diesel crankcase lubricants. More particularly this invention relates to improving the dispersancy retention capability of crankcase lubricants.

BACKGROUND OF INVENTION

The performance criteria for lubricants such as those used in the crankcase of diesel and spark ignition engines may become increasingly more severe as users require lubricants with longer useful lives. For this and other reasons, the efficiency and useful lives of oil-based lubricants, particularly crankcase lubricants, must be improved.

Oxidation of the oil component in the lubricant substantially shortens its useful life. Oxidation yields deposit precursors, corrosive acids, and an undesirable increase in viscosity. While high quality basestocks tend to be relatively resistant to oxidation, contaminants (e.g., iron) and common additives can greatly accelerate oxidation. Inclusion of dispersants (e.g., polyamine or polyester derivatives of alkenyl succinic acids or anhydrides) is desirable for oil performance, but these additives may also be oxidized in the oil, which is undesirable; and in any event experience has shown that the effectiveness of dispersants decreases with time, probably due to degradation of the dispersant.

Despite the great volume of research directed toward improving the useful life of lubricants, particularly crankcase lubricants, there remains a need for improving the dispersancy retention capability of crankcase lubricants.

SUMMARY OF INVENTION

Surprisingly, it has now been found that use of oil soluble organomolybdenum compounds in combination with phenolic or aminic antioxidant improves the dispersion retention capability of crankcase lubricants. Thus, in one embodiment the present invention comprises improving dispersancy retention of a crankcase lubricant by including in the crankcase lubricant composition an oil soluble organomolybdenum compound and at least one of a phenolic or an aminic antioxidant. Particularly preferred organomolybdenum compounds are molybdenum dithiocarbamates while a mixture of a diarylamine and two alkyl phenols are preferred antioxidants.

These and other embodiments of the present invention will be described in detail hereinafter.

DETAILED DESCRIPTION OF THE INVENTION

The crankcase lubricant compositions in the present invention are those that comprise a major amount of a lubricating oil suitable for use in an engine crankcase, particularly a diesel engine crankcase. Thus, natural or synthetic lubricating oils having a kinematic viscosity in the range of 3.5 to 25 cSt at 100° C. comprise a major portion of the lubricating compositions. In general, these lubricating compositions may include additives commonly used in the usual lubricating oil, such as dispersants, antiwear agents, VI improvers, detergents, rust inhibitor, anticorrosion agents and so forth.

The dispersancy retention properties of such crankcase lubricants is improved in accord with this invention by including in the crankcase lubricant an added oil soluble organomolybdenum compound and at least one of a phenolic or aminic antioxidant compound.

Preferably the organomolybdenum compound is a molybdenum dithiocarbamate. Particularly preferred are molybdenum dialkyl dithiocarbamates having alkyl groups of from about 6 to 18 carbon atoms and especially from 8 to 13 carbon atoms.

The compositions of the present invention include at least one of a phenolic antioxidant and an aminic antioxidant.

I

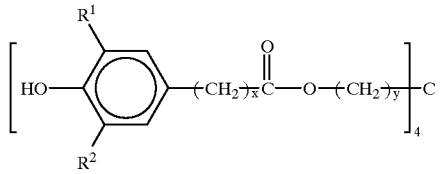

II

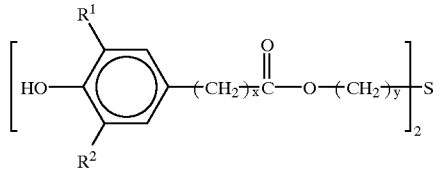

Among the phenolic antioxidants hindered phenols are preferred. The preferred or hindered phenols may be represented by the formula (I) and (II), where $R^1$ and $R^2$ may be the same or different alkyl groups containing 3 to 9 carbon atoms and x and y are integers of from 1 to about 4 and preferably x is 2 and y is 1 to 2.

Suitable amine antioxidants for use in the compositions of this invention are diaryl amines, aryl naphthyl amines and alkyl derivatives of diaryl amines and aryl naphthyl amines. Preferred aminic antioxidants are represented by formula III.

III

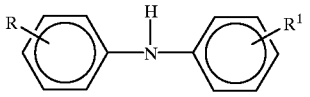

wherein R and $R^1$ are independently alkyl groups of from about 6 to about 12 carbon atoms.

In general the organomolybdenum compound and the antioxidant when added to the crankcase lubricant will comprise a minor amount of the total crankcase lubricant composition. For example, the molybdenum compound typically will comprise about 0.05 to about 2.00 wt % of the total composition and the antioxidant, about 0.10 to about 3.00 wt %.

It has been also found that if the weight ratio of molybdenum compound to antioxidant is in the range of about 80:20 to about 20:80 optimum dispersancy retention is achieved by the combined additives of the present invention.

It is particularly preferred that the antioxidant comprise a mixture of the phenols I and II above and the diaryl amine III in a weight ratio ranging from about 80:10:10 to about 40:20:40, and preferrably 75:15:15 respectively.

Optionally, the additives may be combined with a carrier liquid in the form of a concentrate. The concentration of the combined additives in the concentrate may vary from 1 to 80% by weight but preferrably will be in the range of 5 to 10 wt. %.

The following examples further illustrate the invention.

EXAMPLE 1

A series of test oils were prepared having the compositions shown in Table 1.

TABLE 1

| Components | TEST OIL A | B | C | D |
|---|---|---|---|---|
| Base stock[1], wt % | 98.0 | 97.0 | 97.0 | 97.0 |
| PARANOX 106[2], wt % | 2.0 | 2.0 | 2.0 | 2.0 |
| Molyvan 822[3] | | 1.0 | | 0.5 |
| Irganox L150[4] | | | 1.0 | 0.5 |

[1]Soot-laden used 600SN from engine test, containing 4.4 wt. % soot.
[2]A trade name for polyisobutylene succinamide sold by Exxon Chemical Company, Houston, TX
[3]A trade name for a molybdenum dithiocarbamate having $C_{11}$ to $C_{13}$ alkyl groups sold by R. T. Vanderbilt Co., Norwalk, CT.
[4]A trade name for a mixture of diarylamine of formula III and phenols of formula I and II in the ratio of 70:15:15 and sold by Ciba-Geigy, Basel, Switzerland.

These oils were then tested in a bench oxidation test which was conducted at 165° C. under a mixed air/nitrogen flow, with 40 ppm iron from added Ferric Acetylacetonate as a catalyst. The flow rates of air and nitrogen were controlled at 500 ml/min. and 350 ml/min., respectively.

TABLE 2

| Test Oil | Kinematic Viscosity @ 100° C., cSt 0 Hours | 8 Hours | 16 Hours | 24 Hours | 32 Hours |
|---|---|---|---|---|---|
| A | 16.12 | 19.89 | 27.55 | 33.68 | 44.10 |
| B | 15.92 | 17.84 | 23.90 | 26.55 | 32.79 |
| C | 15.77 | 17.27 | 19.85 | 23.97 | 29.84 |
| D | 16.02 | 17.03 | 19.81 | 23.11 | 26.36 |

EXAMPLE 2

The second series of test oils were prepared having the compositions as shown in Table 3.

TABLE 3

| Components[1] | TEST OIL E | F | G | H | I | J |
|---|---|---|---|---|---|---|
| Soot-Laden 600SN*, wt. % | 97.0 | 97.0 | 97.0 | 97.0 | 97.0 | 97.0 |
| Paranox 106, wt % | 2.0 | 2.0 | 2.0 | 2.0 | 2.0 | 2.0 |
| Molyvan 822, wt % | — | 0.2 | 0.4 | 0.6 | 0.8 | 1.0 |
| Irganox L150, wt % | 1.0 | 0.8 | 0.6 | 0.4 | 0.2 | — |

[1]See Table 1 for specific component descriptions

The same bench oxidation test described in Example 1 was conducted at the different ratios of the organomolybdenum compound to the antioxidant mixture, but samples of the test oils were only taken at 32 hour. The results are given in Table 4.

TABLE 4

| Results | TEST OIL E | F | G | H | I | J |
|---|---|---|---|---|---|---|
| Before Test, KV @ 100° C., cSt | 16.00 | 16.29 | 15.94 | 15.93 | 15.95 | 15.97 |
| After Test, KV @ 100° C., cSt | 32.26 | 27.38 | 25.66 | 26.05 | 25.67 | 30.05 |
| % Increase | 101.6 | 68.1 | 61.0 | 63.5 | 60.9 | 88.2 |

EXAMPLE 3

In the absence of soot, the effect of oxidation on dispersancy in the absence of soot as well as the effect of different antioxidants are shown in Example 3. In this example, the test oil was first oxidized in the same bench oxidation described in Example 1. The composition of the test oils are given in Table 5.

TABLE 5

| Components[1] | TEST OILS K | L | M | N | O |
|---|---|---|---|---|---|
| 600 SN, wt % | 97.0 | 97.0 | 97.0 | 97.0 | 97.0 |
| Paranox 106, wt % | 6.0 | 6.0 | 6.0 | 6.0 | 6.0 |
| Molyvan 822, wt % | — | — | 0.5 | — | 0.5 |
| Irganox L150, wt % | — | 1.0 | 0.5 | — | — |
| Hitec 4728,[2] wt % | — | — | — | 1.0 | 0.5 |

[1]See Table 1 for specific component descriptions
[2]A methylene-bridged alkyl phenol sold by Ethyl Petroleum Additives, Inc., Richmond, VA The remaining dispersancy of the test oil after 32 hours in the bench oxidation test was then determined by use of the GM 6.2L soot-laden basestock dispersancy test. In the GM 6.2L soot-laden basestock dispersancy test, the soot dispersancy of a used oil was determined by the viscosity ratio of the diluted test oil in the presence and absence of soot; the lower the ratio, the better the dispersancy. The test oil was mixed with the soot-laden 600 SN (4.4 wt. % soot) from the GM 6.2L engine at the ratio of 25:75 and the kinematic viscosity at 100° C. was measured. At the same time, the kinematic viscosity at 100° C. of the test oil—fresh base oil mixture at the same ratio (25:75) was also obtained. The results are given in Table 6.

TABLE 6

| Test Results | TEST OILS K | L | M | N | O |
|---|---|---|---|---|---|
| Fresh Oil KV @ 100° C., cSt | 13.08 | 13.06 | 13.03 | 13.15 | 13.11 |
| Used Oil KV @ 100° C., cSt | 30.99 | 14.52 | 13.59 | 23.69 | 16.96 |
| Used Oil/Soot-Laden 600SN Mixture (25/75) KV @ 100° C., cSt | 24.35 | 19.05 | 17.84 | 23.95 | 20.99 |
| Used Oil/Fresh 600SN Mixture (25/75) KV @ 100° C., cSt | 13.85 | 11.96 | 11.82 | 13.64 | 12.37 |
| Relative Viscosity (Viscosity Ratio) | 1.76 | 1.59 | 1.51 | 1.76 | 1.70 |

EXAMPLE 4

In this example, the method described in the present invention can be used as a top treat for a fully formulated diesel engine oil. A commercial heavy duty diesel engine oil was used which comprised solvent neutral basestock mixtures, an olefin copolymer VI improver, a detergent-inhibitor package containing dispersant, detergent, antiwear agent, antioxidant and a pour point depressant mixture. This fully formulated diesel engine oil also contained approximately 100 ppm of organomolybdenum compound. The soot dispersancy results, as measured by the GM 6.2L soot-laden basestock dispersancy test, as described in Example 3, of the engine oil at 8, 16, 24, and 32 hours in the bech oxidation test, as described in Example 1, are given in Table 7.

TABLE 7

| | Fresh | 8 Hours | 16 Hours | 24 Hours | 32 Hours |
|---|---|---|---|---|---|
| Used Oil KV @ 100° C., cSt | 15.23 | 13.79 | 13.12 | 13.15 | 13.58 |
| GM 6.2L Soot Dispersancy Test | | | | | |
| 25/70 mixture with Soot-Laden 600 SN, KV @ 100° C., cSt | 14.30 | 14.06 | 15.03 | 16.01 | 16.44 |
| 25/70 mixture with Fresh 600 SN, Calculated KV @ 100° C.,*** cSt | 12.28 | 11.92 | 11.75 | 11.76 | 11.86 |
| Relative Viscosity (Viscosity Ratio) | 1.16 | 1.18 | 1.28 | 1.36 | 1.39 |

***Calculated based on weighted average viscosity

Since this fully formulated diesel engine oil contained approximately 100 ppm organomolybdenum compound already, 1.0 wt. % Irganox L 150 was added and the soot dispersancy was determined at 8, 16, 24, and 32 hours in the bench oxidation test. The results are given in Table 8.

TABLE 8

| | 8 Hours | 16 Hours | 24 Hours | 32 Hours |
|---|---|---|---|---|
| KV @ 100° C., cSt | 14.76 | 14.76 | 14.75 | 15.04 |
| GM 6.2L Soot Dispersancy Test | | | | |
| 25/70 mixture with Soot-Laden 600 SN, KV @ 100° C., cSt | 14.30 | 14.31 | 14.49 | 15.20 |
| 25/70 mixture with Fresh 600 SN, Calculated KV @ 100° C.,*** cSt | 12.16 | 12.16 | 12.16 | 12.23 |
| Relative Viscosity (Viscosity Ratio) | 1.18 | 1.18 | 1.19 | 1.24 |

***Calculated based on weighted average viscosity

What is claimed is:

1. A method for improving the dispersancy retention of a crankcase lubricant composition comprising including in the crankcase lubricant composition an oil-soluble, organomolybdenum compound and a phenolic and aminic antioxidant, wherein the phenolic antioxidant is selected from mixtures of phenols having the formula I and II:

I

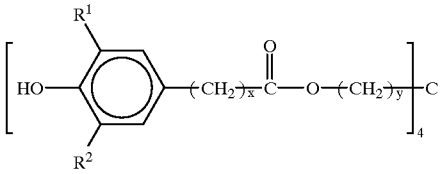

-continued

II

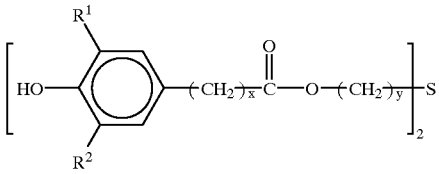

wherein $R^1$ and $R^2$ are the same or different alkyl group of from 3 to 9 carbon atoms and x and y are integers of from 1 to 4, wherein the aminic antioxidant is represented by the formula III:

III

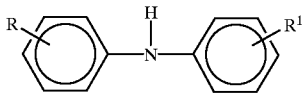

wherein R and $R^1$ are independently alkyl groups of about 6 to about 12 carbon atoms, the molybdenum and antioxidant being present in a weight ratio in the range of about 80:20 to about 20:80.

2. The method of claim 1 wherein the organomolybdenum compound is a molybdenum dithiocarbamate having alkyl groups of from about 6 to about 18 carbon atoms.

3. The method of claim 1 wherein the antioxidant comprises a mixture of phenols of formula I and II and an amine of formula III in the weight ratio ranging from about 80:10:10 to about 40:20:40.

4. In a method of operating a diesel engine having a crankcase the improvement comprising having in the crankcase a lubrication composition comprising a major amount of an oil of lubricating viscosity and a minor amount of an oil-soluble, organomolybdenum compound and a phenolic and aminic antioxidant, wherein the phenolic antioxidant is selected from mixtures of phenols having the formula I and II:

I

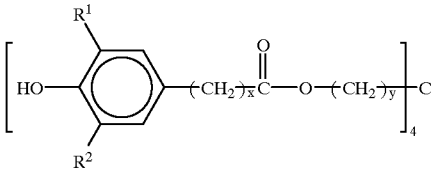

II

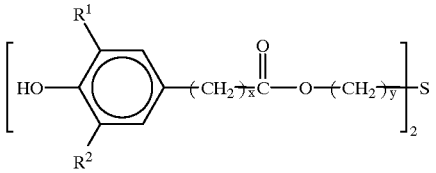

wherein $R^1$ and $R^2$ are the same or different alkyl group of from 3 to 9 carbon atoms and x and y are integers of from 1 to 4, wherein the aminic antioxidant is represented by the formula III:

III

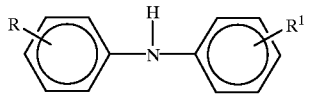

wherein R and $R^1$ are independently alkyl groups of about 6 to about 12 carbon atoms, the molybdenum and antioxidant compound being present in a weight ratio in the range of about 80:20 to about 20:80.

5. The improvement of claim 4 wherein the organomolybdenum compound is a molybdenum dithiocarbamate having alkyl groups of from about 6 to about 18 carbon atoms.

6. The improvement of claim 4 wherein the antioxidant comprises a mixture of phenols of formula I and II and an amine of formula III in the weight ratio in the ranging of from about 80:10:10 to about 40:20:40.

* * * * *